United States Patent [19]

Rebmann et al.

[11] Patent Number: 4,693,052

[45] Date of Patent: Sep. 15, 1987

[54] APPARATUS FOR ASEPTIC PACKAGING

[75] Inventors: Manfred Rebmann, Weinstadt; Otto Rothermel, Stuttgart; Willi Stirnkorb, Waiblingen-Hegnach, all of Fed. Rep. of Germany

[73] Assignee: Robert Bosch GmbH, Stuttgart, Fed. Rep. of Germany

[21] Appl. No.: 942,645

[22] Filed: Dec. 17, 1986

[30] Foreign Application Priority Data

Mar. 6, 1986 [DE] Fed. Rep. of Germany ..... 3607322

[51] Int. Cl.[4] ..... B65B 55/02

[52] U.S. Cl. ..... 53/167; 198/860.3; 422/304; 53/282

[58] Field of Search ..... 53/425, 426, 167, 282; 422/304; 198/860.3

[56] References Cited

U.S. PATENT DOCUMENTS 3,757,622 9/1973 Berry ..... 422/304 X 3,911,640 10/1975 Rausing ..... 53/167 X

FOREIGN PATENT DOCUMENTS 2919015 11/1980 Fed. Rep. of Germany .

530307 12/1972 Switzerland .

*Primary Examiner*—John Sipos

*Attorney, Agent, or Firm*—Edwin E. Greigg

[57] ABSTRACT

An apparatus for aseptic packaging, in particular of food products and snack items, in packaging containers has a clean room with a sterile atmosphere, in which equipment for sterilization, rinsing, filling and closing the packaging containers is disposed. The packaging containers are conveyed in increments through the clean room on supporting elements, which are secured to two parallel endless conveyor chains. To prevent infection of the clean room from the conveyor apparatus, only the supporting elements are carried through the clean room, while the conveyor chains are disposed outside thereof. Holders, which join the supporting elements to the conveyor chains travel longitudinally through slits of the wall of the clean room. Secured to the holders are lamellae, which together with the edge portions of the slit in the wall form a labyrinth seal.

9 Claims, 3 Drawing Figures

APPARATUS FOR ASEPTIC PACKAGING

BACKGROUND OF THE INVENTION

The invention is based on an apparatus for aseptic packaging of products, in particular foods and snack items, in packaging containers as defined hereinafter. In equipment of this type known for instance from German Offenlegungsschrift No. 29 19 015 and Swiss patent No. 530 307, the straight flights of the conveyor chains which have the supporting elements for the packaging containers are arranged to extend through a clean room. Since the links of the conveyor chain have to be lubricated with grease, the known disposition of the conveyor chains has the disadvantage that with their film of lubricant, these chains readily take on germs from the environment and carry them into the clean room. In the clean room, such germs can then infect the sterile product and/or individual packaging containers, thereby exposing the contents of such packages to spoilage.

OBJECT AND SUMMARY OF THE INVENTION

The apparatus according to the invention for aseptic packaging of products has the advantage over the prior art of preventing infection from the conveyor chain lubricant in the packaging of sterile products. A further advantage is that the interior of the clean room, the handling equipment located in it and the supporting elements of the conveyor apparatus can be cleaned with water as well as with cleansing and sterilizing agents, without putting the conveyor chain and its lubrication into contact with these agents. Special rust-prevention provisions for the conveyor chain can accordingly be dispensed with.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
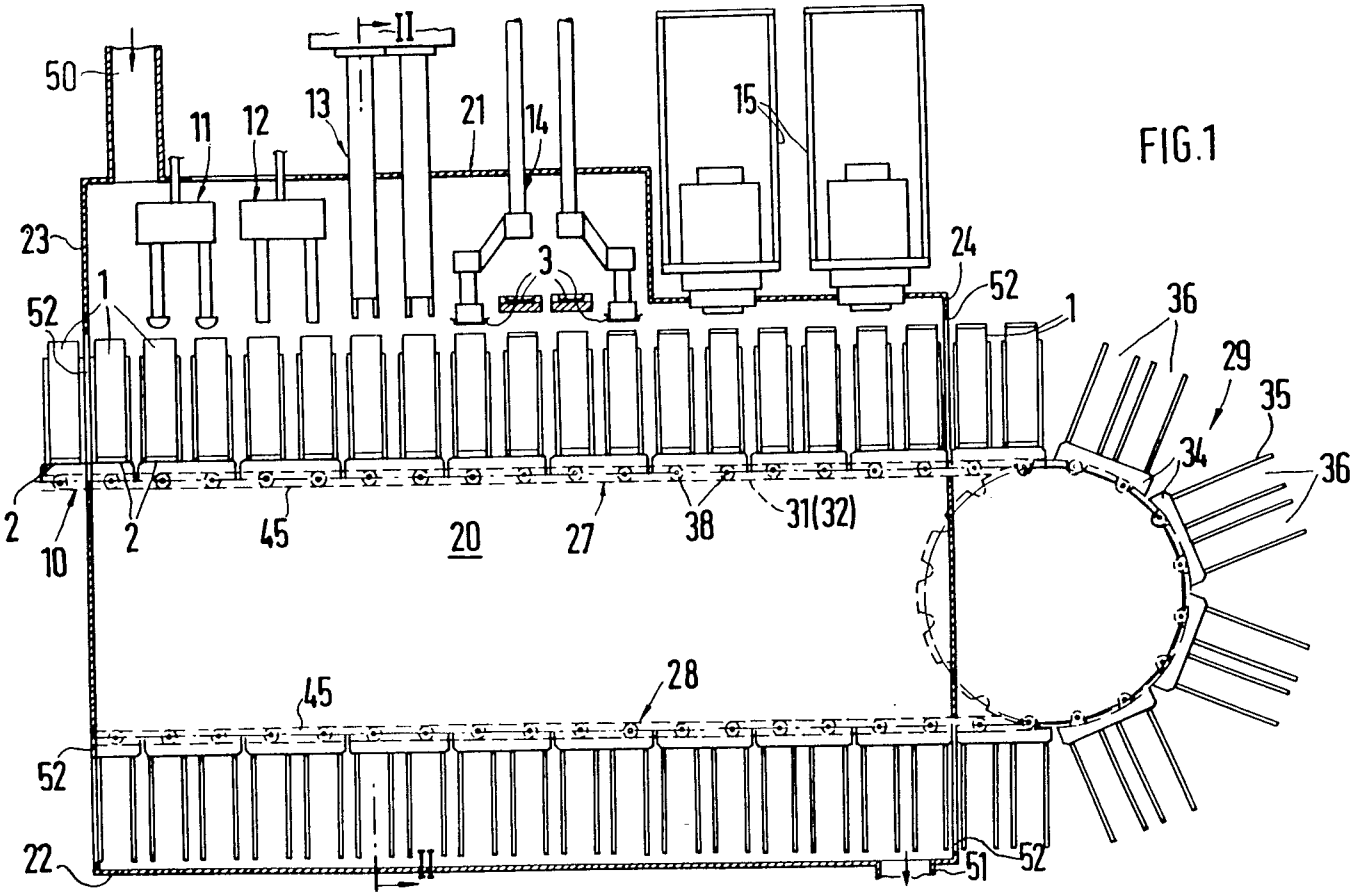
FIG. 1 in simplified form and in longitudinal section, shows an apparatus for the sterilization and aseptic filling and closure of packaging containers.
Figure 2:
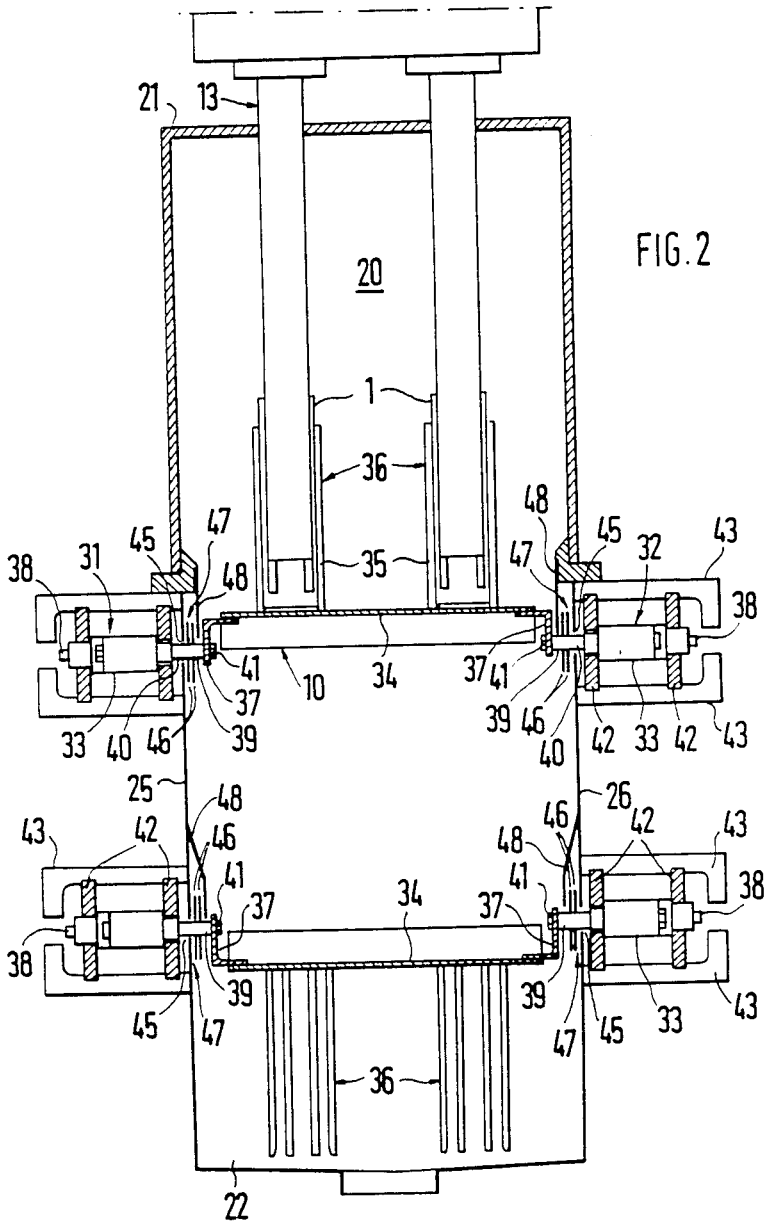
FIG. 2 shows the apparatus of FIG. 1 on a larger scale in a cross section taken in the plane II—II of FIG. 1.
Figure 3:
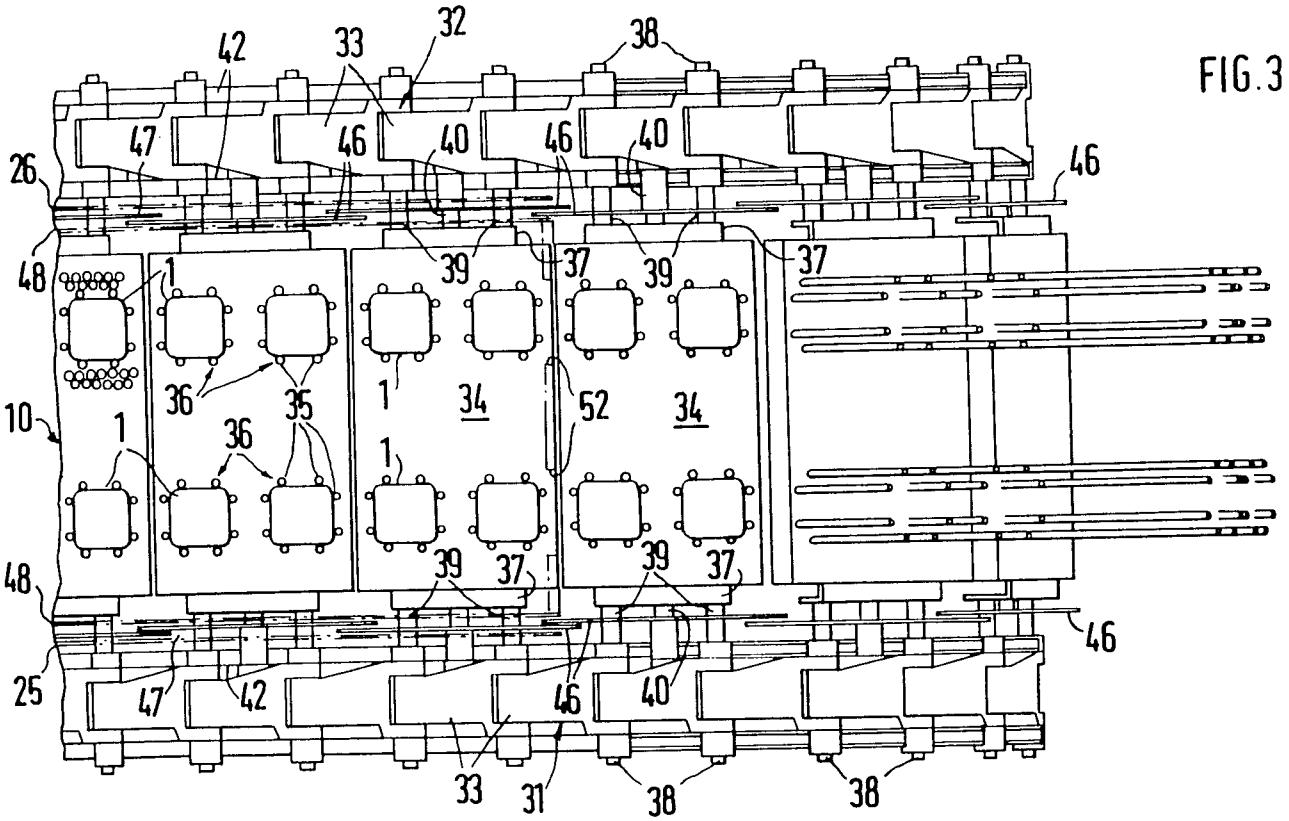
FIG. 3 shows a portion of the conveyor apparatus of the apparatus of FIGS. 1 and 2 in plan view, on a larger scale.

The packaging apparatus shown has an endless conveyor apparatus 10, which delivers packaging containers 1 incrementally one after another to a sterilizing apparatus 11, a rinsing apparatus 12, a filling apparatus 13, a lid-placement apparatus 14 and sealing devices 15. This handling equipment identified as 11–15 is disposed in a clean room 20, or protrudes into the clean room above the delivered containers 1. The box-like clean room 20 has an upper wall 21 and a lower wall 22, a front wall 23 and a rear wall 24, and two side walls 25, 26. The endless conveyor apparatus 10 has two deflection segments 29, of which only the one on the delivery end is shown. The conveyor apparatus 10 comprises two endless spaced-apart conveyor chains 31, 32, which extends in vertical parallel planes, and supporting plates

34 spanning the space between chains 31, 32 and joined to the individual links 33 of the chains 31, 32. Offstanding rods 35 are secured to the supporting plates 34, forming baskets 36 adapted to receive packaging containers 1, for instance four baskets 36 per supporting plate 34. The supporting plates 34 extend in a horizontal plane in the straight segments and have angle bracket fasteners 37 at their ends, with which they are joined to the individual links 33 of the conveyor chains 31, 32. The bolts 38 that pivotably connect the links 33 of the conveyor chains 31, 32 to one another protrude toward the supporting plates 34, forming holders 39 for the supporting plates 34. Every other chain link of each chain 31, 32 also has a retaining pin 40 that protrudes in the same direction as the holders 39. Each angle bracket fastener 37 is secured with screws 41 to two adjacent holders 39 of the bolts 38 and to one retaining pin 40 located between them. The conveyor chains 31, 32 are guided on their straight segments between guide rails 42, which are adjustably secured to arms 43. For the sake of simplicity, the frame of the apparatus, which supports the arms 43 and the housing as well as the other equipment, is not shown.

The clean room 20 is shaped such that only the supporting plates 34 with their baskets 36 are passed through it, while contrarily the conveyor chains 31, 32 carrying these elements extend outside the clean room. To enable passage of the holders 39 and the retaining pins 40 of the two conveyor chains 31, 32 through the clean room 20 and through the side walls 25, 26 that delineate the clean room 20 from the conveyor chains, these side walls 25, 26 have slits 45 in the travel path of the holders 39 and retaining pins 40. The width of these slits 45 is slightly greater than the height of the holders 39 and retaining pins 40. To seal the clean room 20 off from its surroundings sufficiently well in the vicinity of the slits 45, the slits 45 are included in a labyrinth seal system. To this end, the holders 39 and the retaining pins 40 of every other chain link 33 has a respective elongated lamellae 46. The height of the lamellae 46 is a multiple of the distance by which they are spaced apart from the adjacent wall 25, 26. Successive lamellae 46 are disposed somewhat offset from one another, so that their ends overlap without touching one another. The lamellae 46 are also secured to the holders 39 and retaining pins 40 such that they leave a very narrow gap 47 toward the inside of the side walls 25, 26, which offers a certain resistance to the flow of gas or air through this gap. To prevent sprayed or condensate water from entering the gap 47, an apron 48 extends beside the lamellae 46 toward the interior of the clean room 20, the aprons being located only above the travel path of the holders 39 and retaining pins 40. Sterile air is introduced into the clean room 20 from above, through a conduit 50, at a pressure somewhat higher than ambient pressure, and the exhaust air is carried away through a conduit 51 in the lower wall of the clean room 20. Because of the overpressure of sterile air built up in the clean room 20, which causes sterile air to flow continuously, although in throttled fashion, through the gap 47, the entry of germs into the clean room from its surroundings is prevented.

In the exemplary embodiment shown, only the straight runs of the supporting plates 34 of the conveyor apparatus 10 extend through the clean room 20. Contrarily, the deflection segments 29, for loading and unloading of the packaging containers 1, are located outside the clean room 20. For the passage through the clean room of the supporting plates 34 and baskets 36, along with the packaging containers 1 deposited therein, the front and rear walls 23, 24 of the clean room 20 have suitably shaped openings 52. The openings 52 and the slits 45 are dimensioned such that the opening cross section is as small as possible, yet passage through them without touching them is possible; this keeps the consumption of sterile air as low as possible in the quantities of air flowing through these openings and slits, which are however large enough that the outflowing sterile air prevents the entry of air into the clean room 20 from its surroundings.

In the apparatus described, packaging containers 1, having a bottom 2, that are to be filled are placed in the baskets 36 of the conveyor apparatus 10 on the left-hand side of the clean room 20; preferably, one supporting plate 34 is provided with four packaging containers 1 at a time. After indexing of the conveyor apparatus 10 one or more times, four packaging containers 1 at a time reach the working area of the sterilizing apparatus 11, which in a known manner applies a sterilizing agent, such as hydrogen peroxide, in finely dispersed form to the inside of each packaging container 1. After another indexing step, the rinsing apparatus 12 rinses the remainder of the sterilizing agent out of the packaging containers 1. After one more indexing step, four packaging containers 1 at a time are filled with a sterile product. After that, in the vicinity of the lid-placement apparatus 14, lids 3 are placed upon the openings of the filled packaging containers 1, and after additional conveyor steps of the conveyor apparatus 10, these lids are tightly and firmly sealed to the packaging containers 1 with sealing devices 15. After that, the thus filled and closed packaging containers 1 are carried ot of the clean room 20 by the conveyor apparatus 10, through the rear openings 52. Outside the clean room 20, the packaging containers 1 are removed from the conveyor apparatus 10 and carried away. After passing through the rear deflection segment 29, the supporting plates 34 and baskets 36 re-enter the clean room 20 through the lower openings 52 and leave them once again at the front wall 23 of the sterile room 20.

To prevent water or condensate from being retained on the supporting plates 34, these plates are preferably made of a perforated metal sheet.

In the above-described exemplary embodiment, the supporting plates 34 of the conveyor apapratus 10 are embodied in two rows and two columns for receiving the packaging containers 1. It is also possible within the scope of the invention to provide more than two rows and two columns, if the supporting plates are suitably long. If they are very short, it is also possible to use only one conveyor chain, from which the supporting plates protrude freely at the side, communicating with the links of the conveyor chain through a slit in only one side wall of the clean room.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. An apparatus for aseptic packaging of products comprising a clean room containing a sterile atmosphere at overpressure, said clean room uncompassed by top, bottom, side and oppositely disposed end walls, said end walls arranged to receive through restrictive apertures upper and lower conveyor flights, endless conveying means provided with chain link holder means mounted exteriorly of each of said side walls of said clean room adapted to communicate by said chain link holder means which extend through oppositely disposed slit means in said side walls of said clean room with said conveyor flights and labyrinth seal means disposed interiorally of each of said side walls of said clean room with said labyrinth seal means disposed between said upper and lower conveyor flights and said conveyor means.

2. An apparatus as defined by claim 1, in which said labyrinth seal means further include lamellae which are guided in close proximity to said slit means in said side walls of said clean room.

3. An apparatus as defined by claim 2, in which successive lamellae are secured, offset from one another, to said chain link holder means.

4. An apparatus as defined by claim 1, in which said side walls of said clean room have interior surface areas in proximity to said slit means and apron means on said surface areas adapted to overlie said lamellae.

5. An apparatus as defined by claim 3, in which said side walls of said clean room have interior surface areas in proximity to said slit means and apron means on said surface areas adapted to overlie said lamellae.

6. An apparatus as defined by claim 1, in which said conveyor flights are supporting elements provided with package supporting means.

7. An apparatus as defined by claim 2, in which said conveyor flights are supporting elements provided with package supporting means.

8. An apparatus as defined by claim 3, in which said conveyor flights are supporting elements provided with package supporting means.

9. An apparatus as defined by claim 4, in which said conveyor flights are supporting elements provided with package supporting means.

* * * * *